US006478560B1

(12) United States Patent
Bowman

(10) Patent No.: US 6,478,560 B1
(45) Date of Patent: Nov. 12, 2002

(54) PARALLEL MODULE ROTARY SCREW COMPRESSOR AND METHOD

(75) Inventor: James L. Bowman, Mooresville, NC (US)

(73) Assignee: Ingersoll-Rand Company, Woodcliff Lake, NJ (US)

( * ) Notice: Subject to any disclaimer, the term of this patent is extended or adjusted under 35 U.S.C. 154(b) by 0 days.

(21) Appl. No.: 09/703,611

(22) Filed: Nov. 2, 2000

Related U.S. Application Data

(60) Provisional application No. 60/218,139, filed on Jul. 14, 2000.

(51) Int. Cl.[7] ..... F01C 11/00

(52) U.S. Cl. ..... 418/199; 418/1; 418/69; 418/97; 418/199; 418/201.1

(58) Field of Search ..... 418/201.1, 97, 418/199, 69, 1

(56) References Cited

U.S. PATENT DOCUMENTS

| | | | | | |
|---|---|---|---|---|---|
| 630,648 | A | * | 8/1899 | Brewer | 418/197 |
| 680,596 | A | * | 8/1901 | Jaeger | 418/199 |
| 795,777 | A | * | 7/1905 | Laxton | 418/199 |
| 1,660,287 | A | * | 2/1928 | Willers | 418/39 |
| 2,079,083 | A | * | 5/1937 | Montelius | 418/197 |
| 2,185,338 | A | * | 2/1940 | Hassler | 418/199 |
| 2,575,154 | A | * | 11/1951 | Zoll | 418/199 |
| 2,659,239 | A | * | 11/1953 | Nilsson et al. | 418/200 |
| 2,693,762 | A | * | 11/1954 | Sennet | 418/197 |
| 3,103,894 | A | * | 9/1963 | Sennet | 418/197 |
| 3,181,472 | A | * | 5/1965 | Sennet | 418/197 |
| 3,597,133 | A | * | 8/1971 | Zeitvogel | 418/197 |
| 4,068,984 | A | * | 1/1978 | Spindler | 418/197 |
| 4,076,468 | A | * | 2/1978 | Persson et al. | 418/9 |
| 5,101,782 | A | * | 4/1992 | Yang | 418/9 |
| 5,108,275 | A | * | 4/1992 | Sager | 418/171 |
| 6,093,008 | A | * | 7/2000 | Kirsten | 418/200 |

* cited by examiner

*Primary Examiner*—Thomas Denion
*Assistant Examiner*—Theresa Trieu
(74) *Attorney, Agent, or Firm*—Michael Best & Friedrich LLP

(57) ABSTRACT

A multiple-module, oil-flooded, rotary screw compressor wherein a plurality of compressor modules are driven by a single drive shaft. The modules are positioned in parallel so that a large volume of compressed air can be provided for use in equipment which continuously requires a large supply of such air. The compressor is configured so that each rotary screw compressor module includes a driven gear engaged with the same gear on the drive shaft. The compressor modules may share a common inlet cavity and a common outlet cavity.

17 Claims, 10 Drawing Sheets

PARALLEL MODULE ROTARY SCREW COMPRESSOR AND METHOD

CROSS-REFERENCE TO RELATED APPLICATIONS

This application claims priority to and the benefit of U.S. Provisional Patent Application Ser. No. 60/218,139 entitled "PARALLEL STAGE ROTARY SCREW COMPRESSOR" filed Jul. 14, 2000.

BACKGROUND

The present invention relates to rotary screw compressors. In particular, the present invention relates to oil-flooded rotary screw compressors having multiple modules.

Conventional rotary screw air compressors have included multiple modules. These modules are typically arranged in series so that air is compressed in modules until the desired pressure was reached. U.S. Pat. No. 4,076,468 to Persson, incorporated by reference herein, discloses an example of such a compressor. Persson discloses a compressor having two modules positioned in parallel with one another but acting in series. The pressurized air produced in the first module is supplied to the second module. While higher pressures can be achieved by using multiple module compressors, the amount of fluid flow is limited. Because the modules are arranged in series, the compressor can only discharge the amount of fluid that can be moved through a single module.

However, for some equipment using pressurized fluid (e.g. air) the supply of a large amount of air is more important than a supply of highly pressurized air. For example, some types drilling equipment require the continuous supply of air at 100 psi. This equipment typically runs for long periods of time and requires a constant flow of large volumes of air. Other compressed air systems supply pressurized air to equipment by maintaining a large amount of pressurized air in a storage tank. However, due to the continuous operation of the equipment, the demand for air typically exceeds the available supply and the storage tank is quickly depleted, despite the continuous operation of the compressor. Furthermore, while a single module air compressor may generate sufficient discharge pressure to meet the equipment requirements, an undesirably large module would be required to meet the large volume requirements.

Accordingly, there is a need for a compressor that can provide a large volume of pressurized fluid to meet high demand requirements. As disclosed in U.S. Pat. No. 3,597,133, issued to Zeitvogel et al. and incorporated herein by reference, the capacity of single module rotary screw type compressor may be increased by providing a second female screw. The disclosed system includes one male rotor driven by a drive shaft. The rotation of the male rotor and screw causes the simultaneous and parallel rotation of two female rotors. The systems described in the Zeitvogel patent produces a larger volume of compressed air than the traditional compressor system that includes multiple modules arranged in series, but it also has several disadvantages. A system employing only one male rotor to drive multiple female rotors is reliant on the integrity of the one male rotor. Thus, if the male rotor fails, neither female rotor can act to compress the fluid. Moreover, if either female rotor fails, the entire system must be dismantled to disengage the failed female rotor from the male rotor. Such a time-consuming and labor-intensive process drastically reduces the utility and reliability of this type of compressor. In addition, due to the precise tolerances associated with forming a casing having three aligned bores for receiving the intermeshed rotors as well as the need to precisely set the discharge end clearances, such a system is extremely expensive and time consuming to manufacture.

U.S. Pat. No. 5,108,275 to Sager discloses a rotary screw compressor in which one gear acts on two compressor modules. The system includes two compressor modules which have separate inlets, but are arranged to force compressed air through a common output. The system provides some increase in capacity, however, the Sager system also has certain disadvantages. First, the system requires that the inlet ports be located at opposite ends of the compressor casing and drive shaft. This design makes maintaining and servicing the compressor more difficult. Second, the male rotors and the driven female rotors are positioned on the same drive shaft, thereby reducing the axial and radial forces on the shaft to approximately zero. As a result, the loading on the discharge end of the male and female rotors is essentially eliminated. A load on the rotor discharge ends, however, is required to maintain reliability and stability in a compressor module, Sager's device fails to provide these desirable features. Therefore, there remains a need for a compressor that can produce large quantities of pressurized air and is easy to service and maintain.

The present invention addresses these needs and provides other advantages as well.

SUMMARY OF THE INVENTION

A multi-module rotary screw compressor is provided. The compressor includes a compressor casing having an inlet cavity for receiving a fluid to be pressurized. The compressor contains a plurality of rotary screw compressor modules which are positioned to receive air directly from the inlet cavity. Each of the rotary screw compressor modules includes a male rotor intermeshed with a female rotor. A drive shaft is operatively connected to each of the compressor modules through a main gear. Rotation of the drive shaft causes the male rotors to rotate. The rotation of each of the male rotors causes the female rotors to rotate and thereby compress the fluid.

Preferably, the compressor includes a drive gear mounted to the drive shaft. Each of the male rotors includes a driven gear which engages the drive gear so that rotation of the drive shaft and the drive gear causes a corresponding rotation of the driven gears. Preferably, the ratio of the drive gear to each of the driven gears is the same.

The plurality of compressor modules may consist of first and second compressor modules. The first and second compressor modules should be positioned on opposite sides of the drive gear but not 180° apart in order to maintain the proper radial loading on the drive shaft. Preferably, the rotors are located approximately 150° apart from one another around the drive shaft.

The compressor casing may include an outlet cavity for each of the rotary screw compressor modules whereby compressed fluid produced in each rotary screw compressor module is supplied to the corresponding outlet cavity. Alternatively, the compressor casing may include a common outlet cavity into which the compressed fluid of each of the rotary screw compressor modules is supplied, thereby ensuring that the pressure of the compressed fluid at an outlet of each of the rotary screw compressor modules is substantially the same.

The compressor may be configured so that each of the compressor modules contribute substantially equal volumes of compressed fluid to the outlet cavity. The compressor modules may be oil-flooded rotary screw compressors. The plurality of compressor modules may consist of first and second compressor modules configured so that in the first compressor module the male rotor is positioned above the female rotor and in the second compressor module the male rotor is positioned below said the female rotor.

The compressor may include bearings positioned between the compressor casing and each of the male rotors. These bearings may be positive locking thrust bearings. Each of the driven gears is configured to be disengaged from the drive gear so that the compressor modules may operate independently. If a module is disengaged and the user intends to only use the remaining module, the inlet port corresponding to the disengaged module must be sealed to prevent fluid leakage. Furthermore, an indentical back-up module may be provided to replace a failed module to facilitate the rapid return of the compressor package to twin module operation.

A method of producing compressed air in a compressor casing is also provided. The method includes the steps of: rotating a drive shaft; rotating a first male rotor in a first rotary screw compressor module, wherein the first rotary screw compressor module is operatively connected to the drive shaft; rotating a first female rotor in the first rotary screw compressor module; rotating a second male rotor in a second rotary screw compressor module, wherein the second rotary screw compressor module is operatively connected to the drive shaft; rotating a second female rotor in the second rotary screw compressor module; and providing air to each compressor module through a common inlet cavity so that each compressor module discharges compressed air. The method may include the step positioning the first rotary screw compressor module and the second rotary screw compressor module so that they are on opposite sides of the drive shaft at an angle less than 180°. In addition, the method may include selecting a degree for the angle (between the first and the second rotary screw compressors) such that sufficient loading is maintained on the drive shaft while minimizing the width of the casing. The method may also additional steps including: providing lubricating fluid to each compressor module; providing bearings between the male rotors and the casing to establish an end clearance for each male rotor. In this latter step, the end clearances may be the same.

It is to be understood that both the foregoing general description and the following detailed description are exemplary and explanatory only, and are not restrictive of the invention as claimed.

BRIEF DESCRIPTION OF THE DRAWINGS

These and other features, aspects, and advantages of the present invention will become apparent from the following description, appended claims, and the accompanying exemplary embodiment shown in the drawings, which are briefly described below.

DETAILED DESCRIPTION

Figure 1:
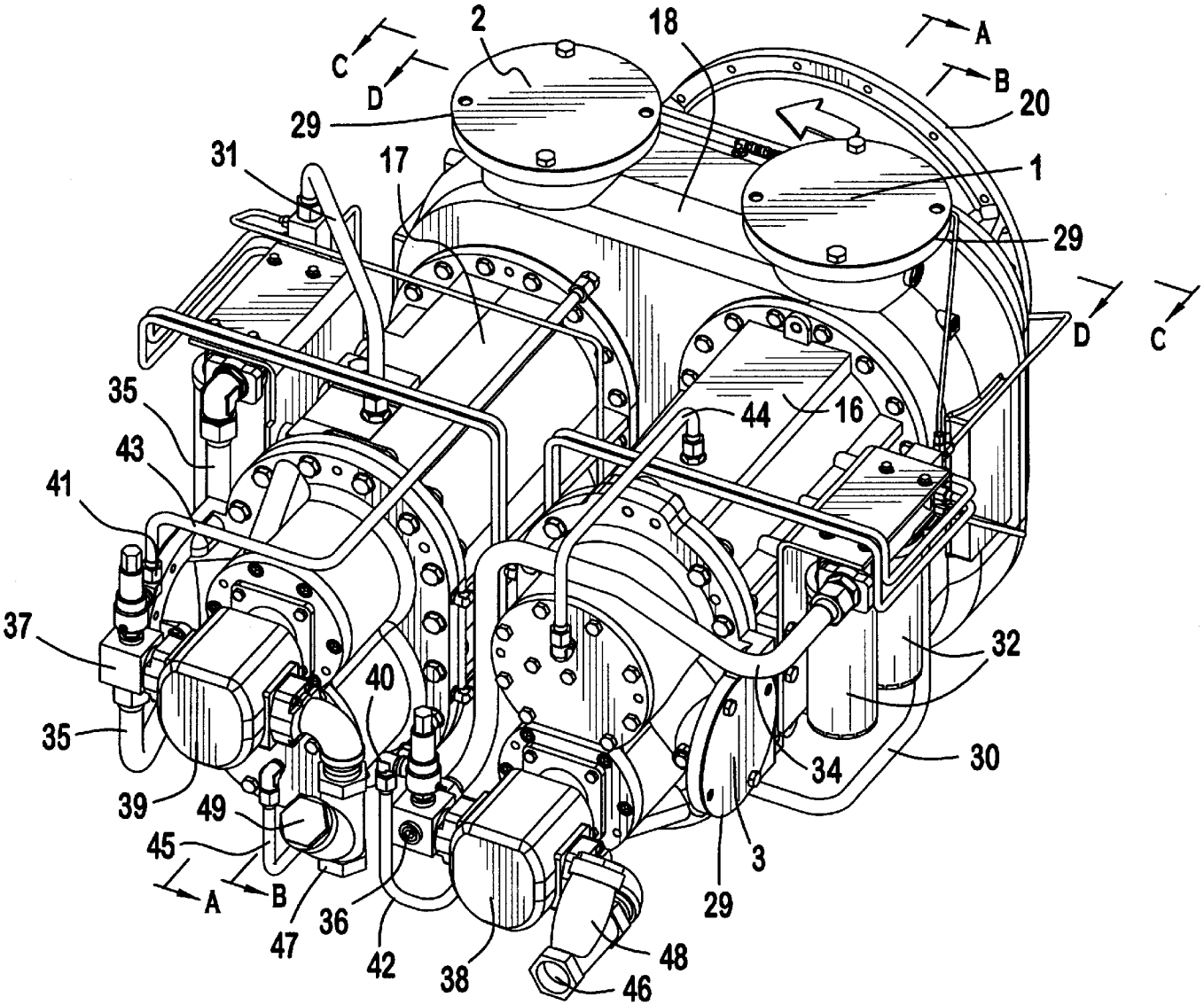
FIG. 1 is a perspective view an air compressor (shown with optional covers on the inlet ports and outlet ports) according to the present invention.

A fluid compressor including two parallel rotary screw compressor modules is provided. Preferably, the compressor modules are identical. The compressor modules or airends are positioned to partially balance the radial loading on the drive shaft. Preferably, the compressor modules draw fluid or air from a common inlet cavity and produce compressed air simultaneously. The modules are positioned so that the air compressed by one module does not enter the inlet of the second module. The modules may have the same inlet pressure as a result of the shared inlet cavity. In addition, the output of the compressor modules may be provided to a common output cavity, resulting in the same discharge pressure for each compressor module. As described below, the compressor includes two compressor modules. However, it is within the scope of the invention to provide multiple compressor modules connected to the same drive shaft.

The arrangement of the compressor modules provides for twice the air flow at the same discharge pressure of a conventional single module compressor. Thus, the high air flow demand requirements of certain equipment may be met (e.g. 2200 cfm at 100 psi; 3000 cfm at 100 psi and 3800 cfm at 100 psi). The compressed air from both modules may be mixed together in a conventional moisture separator tank to remove any entrained lubricant/coolant. The purified highly compressed air can then be made available to equipment requiring a continuous source of compressed air.

The air compressor described herein and shown in the drawings operates conventionally with regard to various support systems and ancillary equipment such as, for example lubricating oil, oil separators, oil coolers, and an air inlet/unloader valve.

Figure 4:
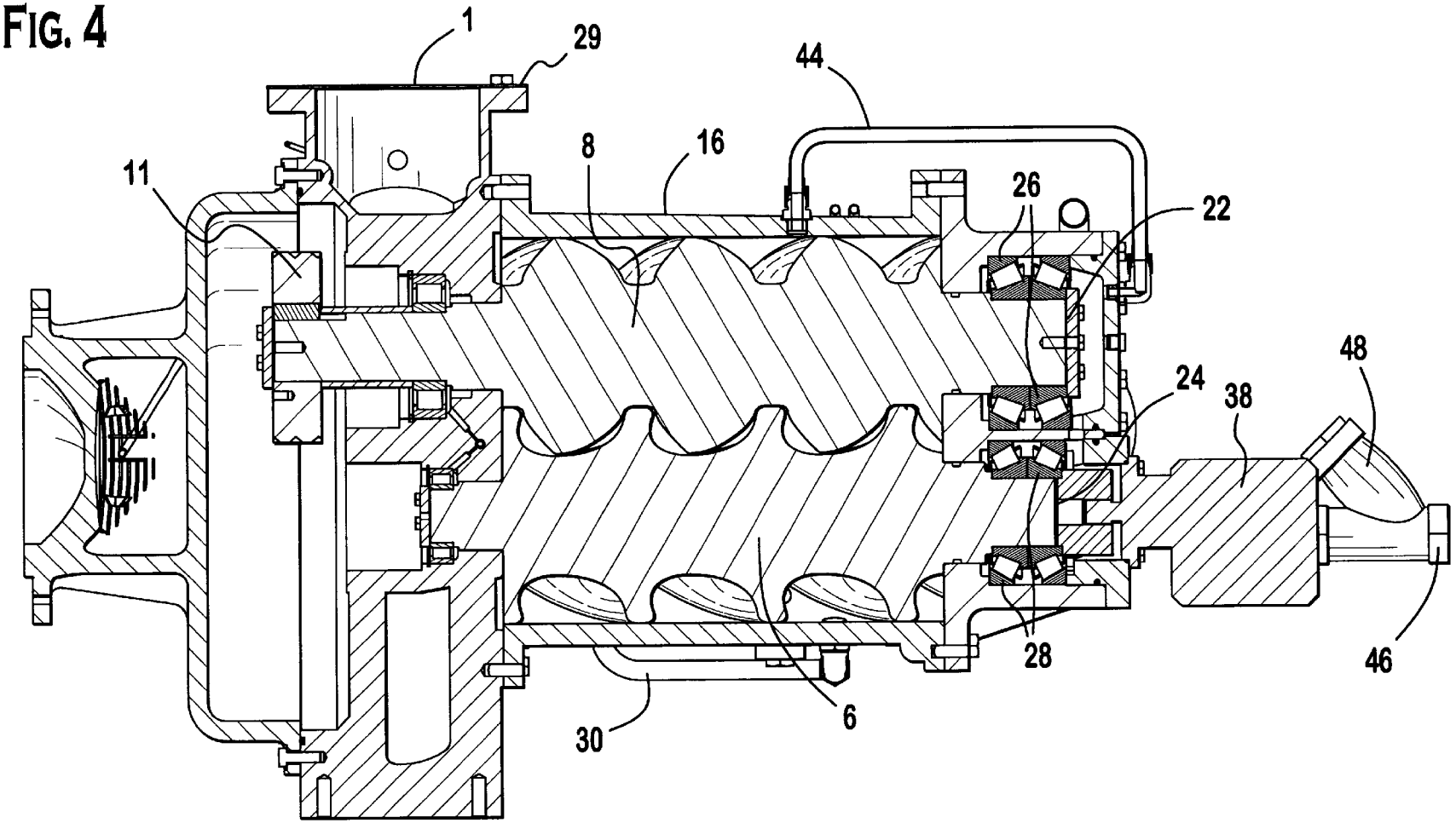
FIG. 4 is a cross-sectional side view of the air compressor of FIG. 1 taken through lines B—B.
Figure 5:
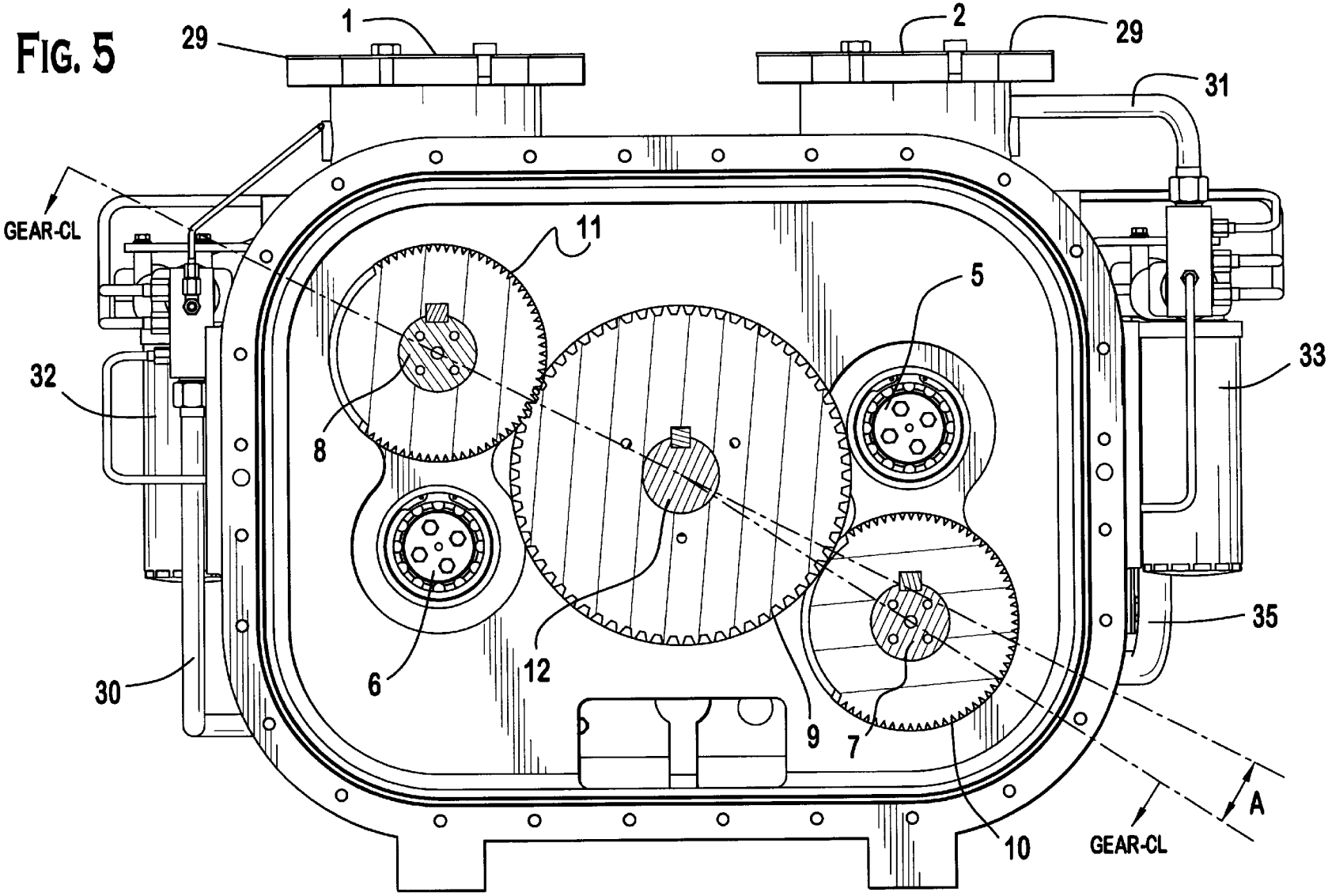
FIG. 5 is a cross-sectional view of the air compressor of FIG. 1 taken through lines C—C showing the drive shaft and gearing arrangement for the compressor modules.

As shown in FIG. 1, the compressor preferably includes two compressor modules 16, 17. Each module or air end is a rotary screw type compressor and includes one male rotor and one female rotor intermeshed with each other. For example, as shown in FIG. 4, the first compressor module 16 includes a male rotor 8 and a female rotor 6. Similarly, compressor module 17 contains a male rotor 7 and a female rotor 5. To minimize the overall size of the compressor package containing the dual modules 16, 17, in one module the male rotor is located above its corresponding female rotor while in the other module the male rotor is located below its corresponding female rotor, as shown in FIG. 5. Moreover, if the modules 16, 17 are identical, this orientation ensures that the outlet ports 3, 4 of the compressor can both be located on exterior sides of the casing (as shown in FIG. 1).

Figure 2:
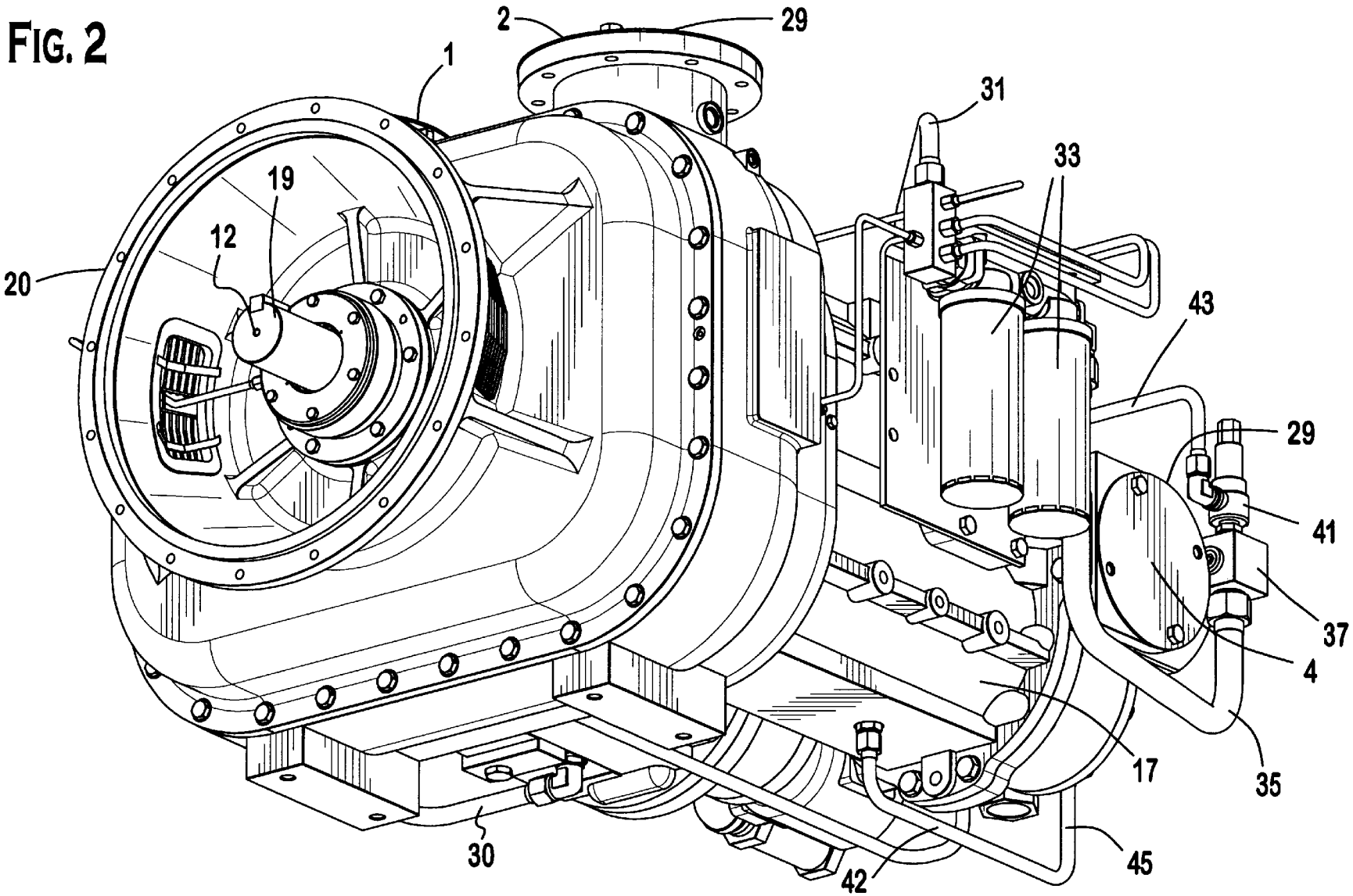
FIG. 2 is a perspective view of the inlet end of the air compressor of FIG. 1.
Figure 3:
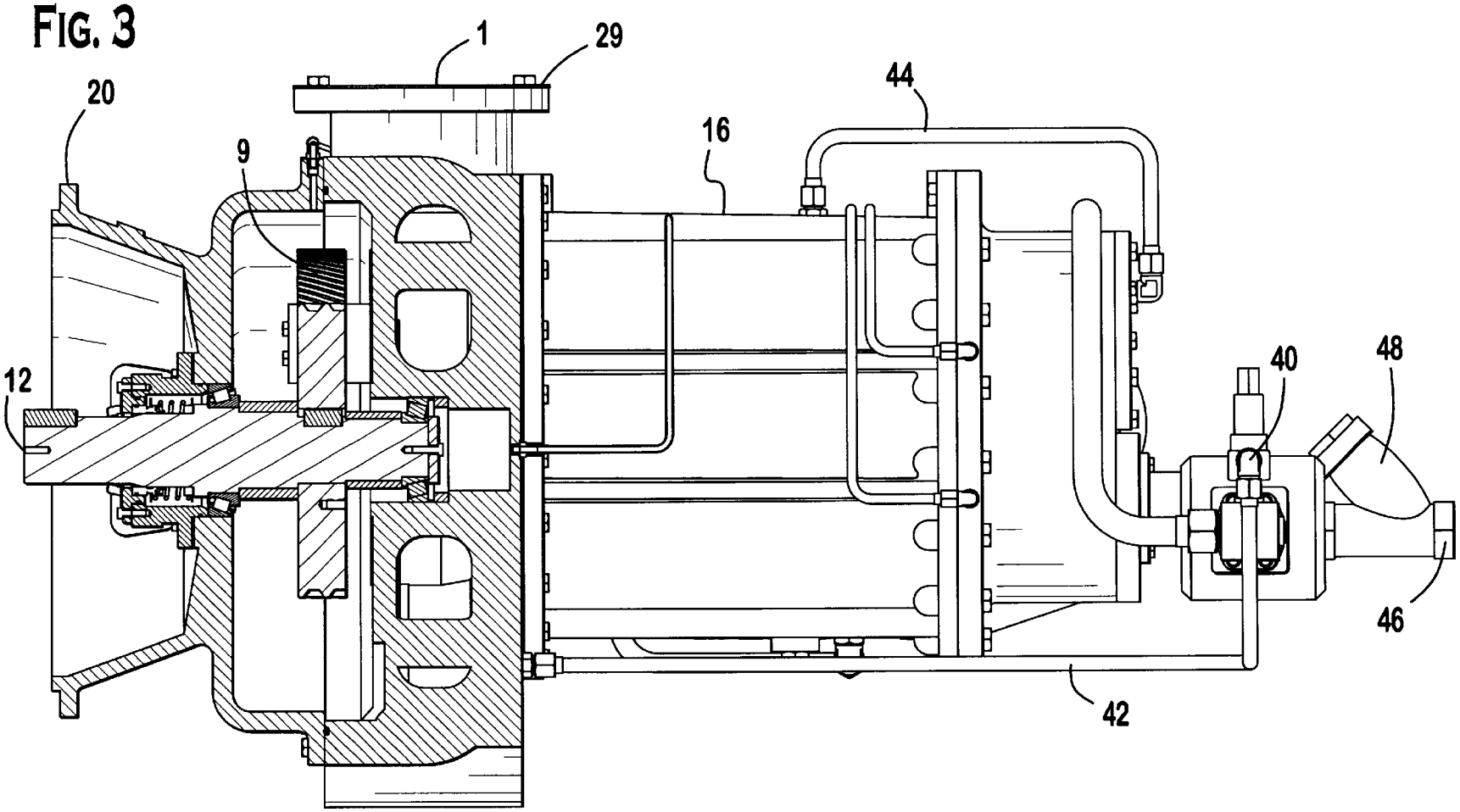
FIG. 3 is a cross-sectional side view of the air compressor of FIG. 1 taken through lines A—A.

The compressor includes a drive shaft 12. Power to the drive shaft is provided by a conventional prime mover (not shown) such as, for example, a diesel engine. The drive shaft 12 extends out of the compressor casing and includes an end 19 configured to be connected to the shaft of the prime mover. As shown in FIG. 2, the compressor includes a drive shaft housing 20 which is adapted to be connected to the prime mover. Rotation of the drive shaft 12 results in the rotation of the male rotors 7, 8. As shown in FIG. 5, both of the compressor modules are driven by the shaft 12. The drive shaft 12 includes a drive gear 9 that rotates with the shaft. The drive gear 9 engages driven gears 10, 11 mounted to each male rotor. Thus, rotation of the drive gear 9 results in the rotation of the driven gears 10, 11 and corresponding rotation of the male rotors 7, 8. Due to the intermeshed configuration, rotation of the male rotors 7, 8 results in a corresponding rotation of the female rotors 5, 6. The male rotors 7, 8 will rotate synchronously thereby ensuring that each compressor module produces compressed fluid with substantially the same properties.

The male rotors are positioned around the drive shaft so that the loading on the drive shaft is properly maintained. As shown in FIG. 5, the male rotors are preferably positioned to be slightly offset from one another on opposite sides of the drive shaft. As shown in FIG. 5, the offset angle A is approximately 30°. By positioning the male rotors 6, 8 asymmetrically around the drive shaft 12 the axial and radial forces on the rotating shafts and the associated bearings are maintained. The male rotors are located approximately 150° apart so that a small radial load is applied to the drive shaft and its associated bearings. The load provides stability to the shaft and bearing arrangement. Further stability to the bearings is provided by the thrust loading from the gears. In addition, as described further below, preferably the compressor includes bearings that maintain a predetermined clearance between the discharge end of the rotary screws and the compressor casing.

As shown in FIG. 4, the first compressor module 16 includes two sets of bearings 26, 28 for the male rotor 8 and the female rotor 6; these bearings are preferably positive locking thrust bearings. The discharge end 22 of the male rotor 8 is supported and the clearance between the compressor casing and the rotor is maintained by the bearings 26. Similarly, the discharge end 24 of the female rotor 6 is supported and the casing clearance is maintained by a set of bearings 28. The second compressor module 17 is identically configured and thereby employs bearings 25 on discharge end 21 of male rotor 7.

As shown in FIG. 5, both of the parallel compressor modules 16,17 (shown in FIG. 1) have driven gears 10, 11 which are turned by a common drive gear 9 which is connected to a drive shaft 12. This configuration allows one of the compressor modules to be replaced in case of failure or maintenance. If a replacement module is unavailable, the compressor package may be aligned for single module operation by scaling or covering the inlet port 1, 2 corresponding to the module being removed from service, for example, via an optional cover 29 or the like.

Figure 6:
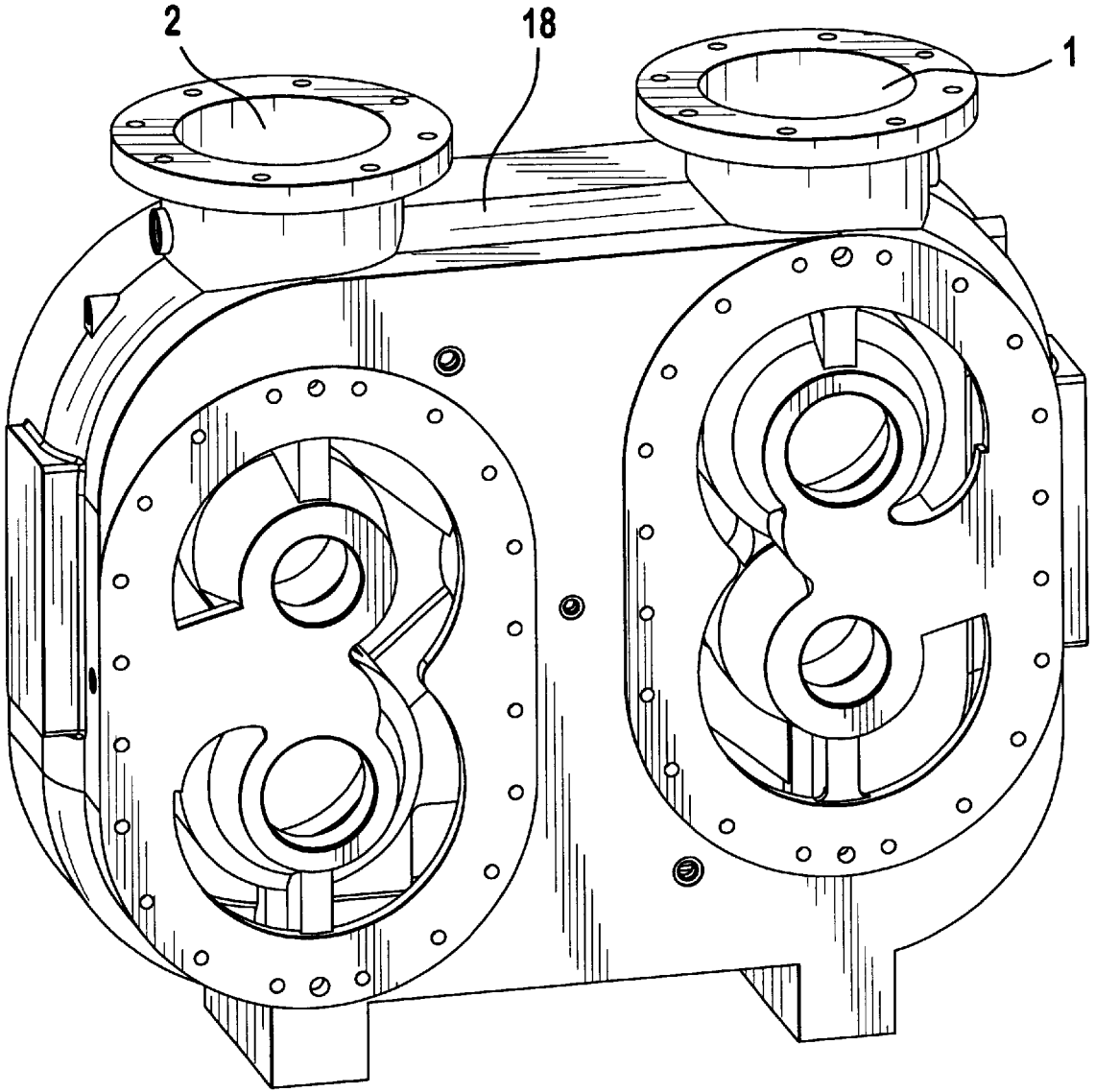
FIG. 6 is a perspective view of the compressor inlet housing.
Figure 7:
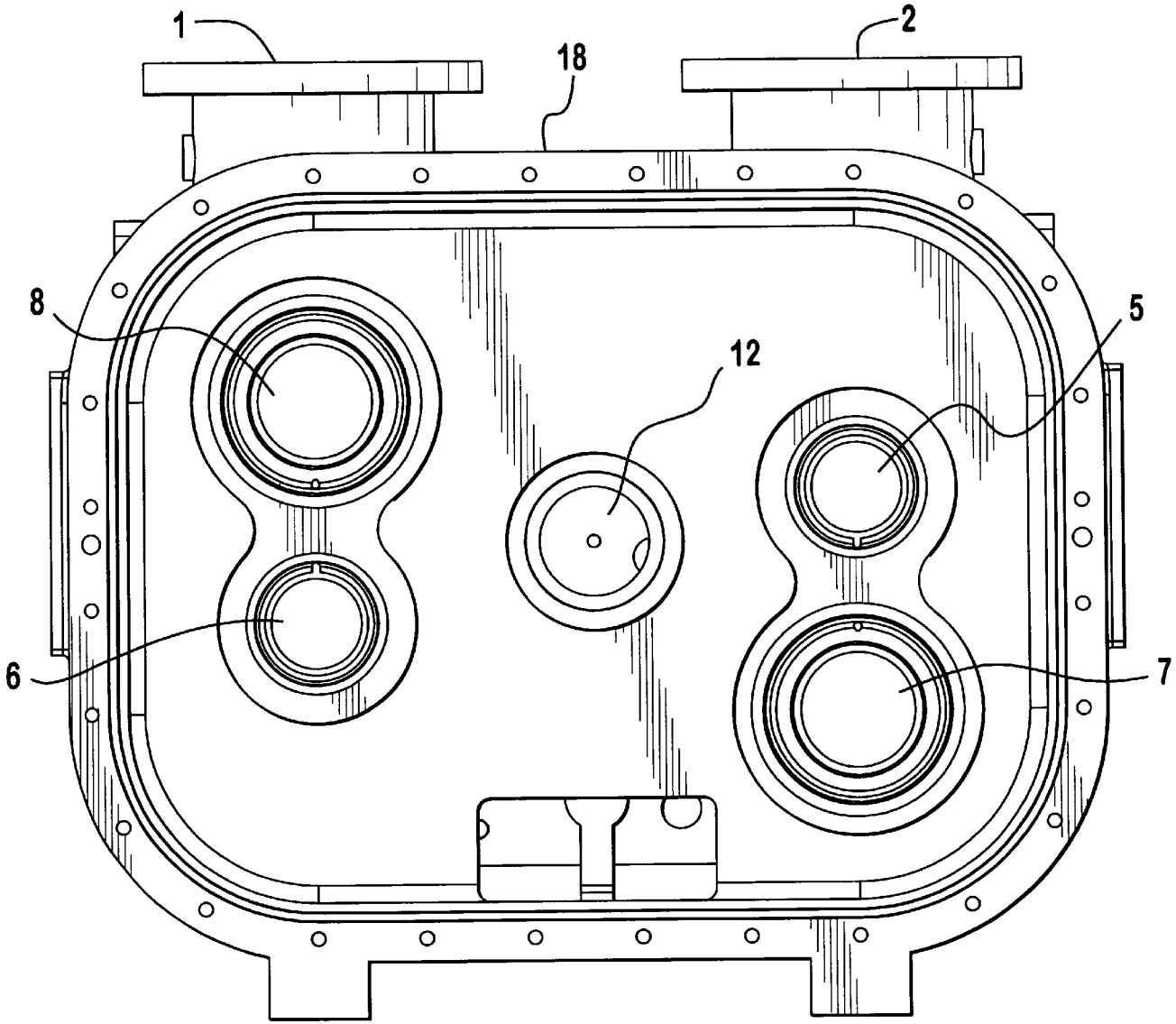
FIG. 7 is an end view of the compressor inlet housing.
Figure 8:
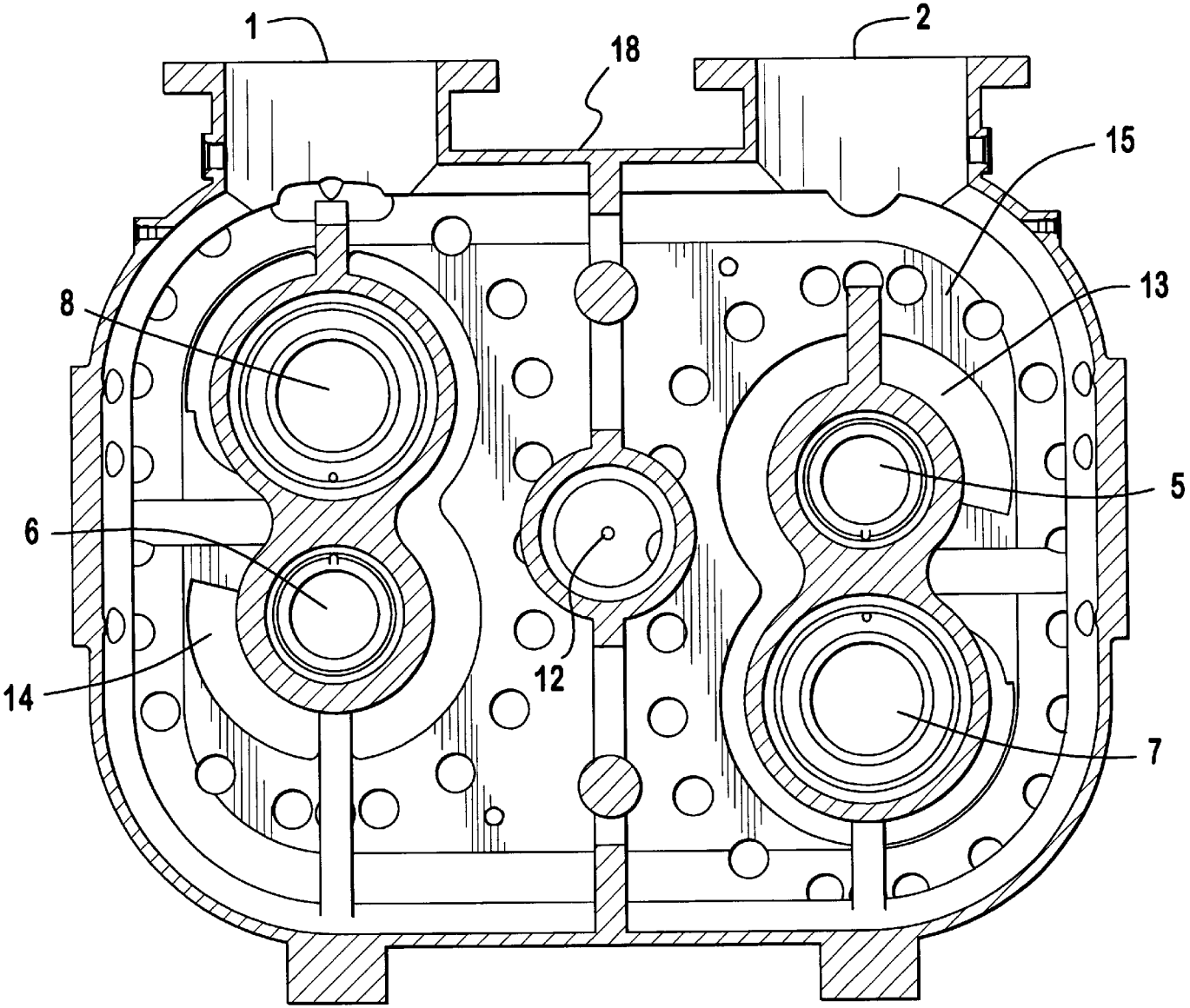
FIG. 8 is a cross-sectional view taken through lines D—D of FIG. 1.
Figure 9:
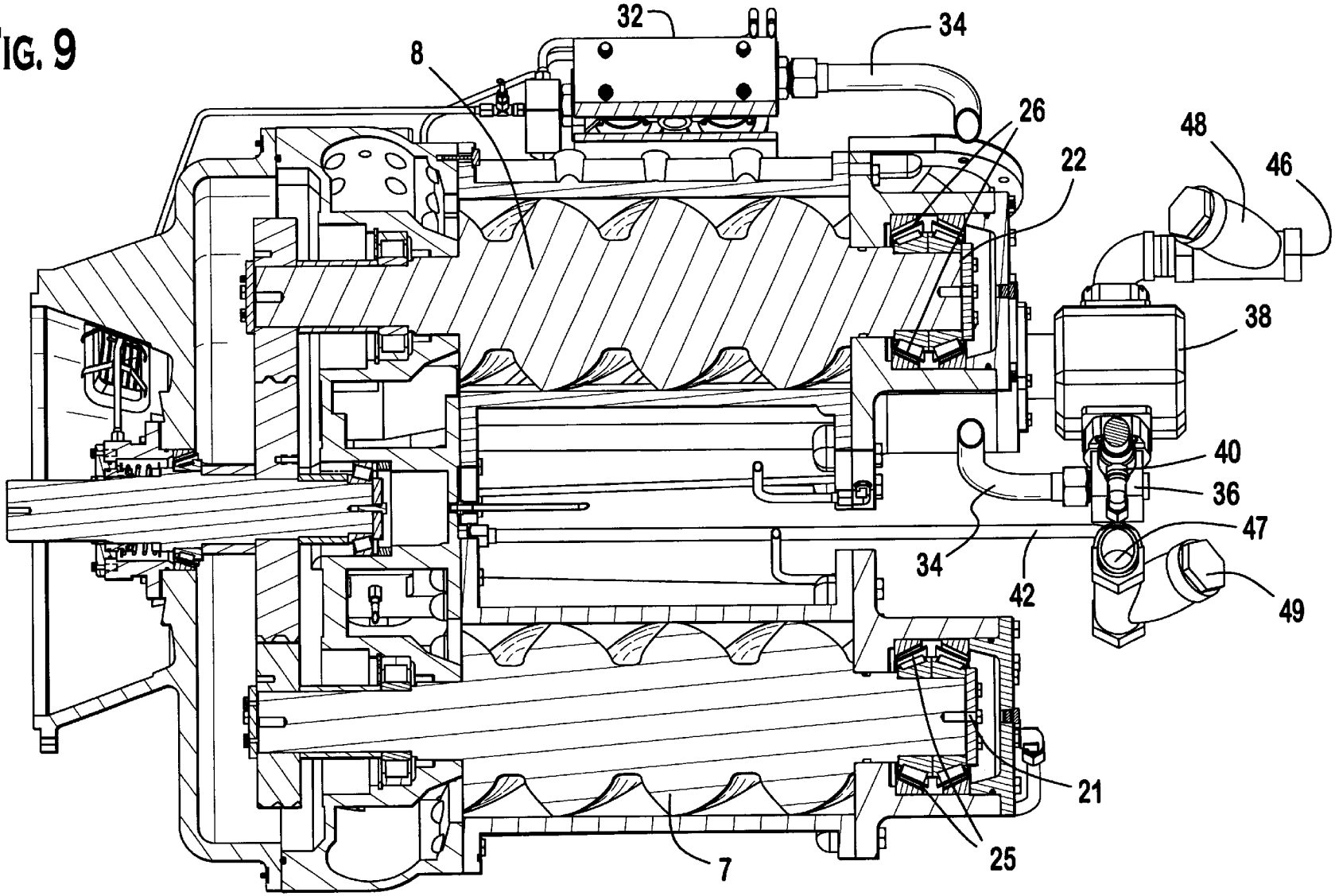
FIG. 9 is a cross-sectional view taken through line GEAR-CL of FIG. 5.

The compressor includes an inlet housing 18 shown in FIG. 6. The inlet housing 18 includes two separate inlet ports 1, 2 through which the fluid to be compressed, preferably air, enters the compressor. The housing 18 includes a common inlet cavity 15 in which fluid to be compressed, that has entered through inlet ports 1, 2, may be mixed. The common inlet cavity 15 ensures that each compressor module is provided with the same amount of fluid to be compressed. The compressor modules will have the same inlet pressure because, although separate inlet ports are provided, the modules are in fluid communication on the inlet side through the cavity 15. As shown in FIG. 8, the inlet housing 18 also includes inlet ports 13, 14 through which air enters the compressor modules.

Figure 10:
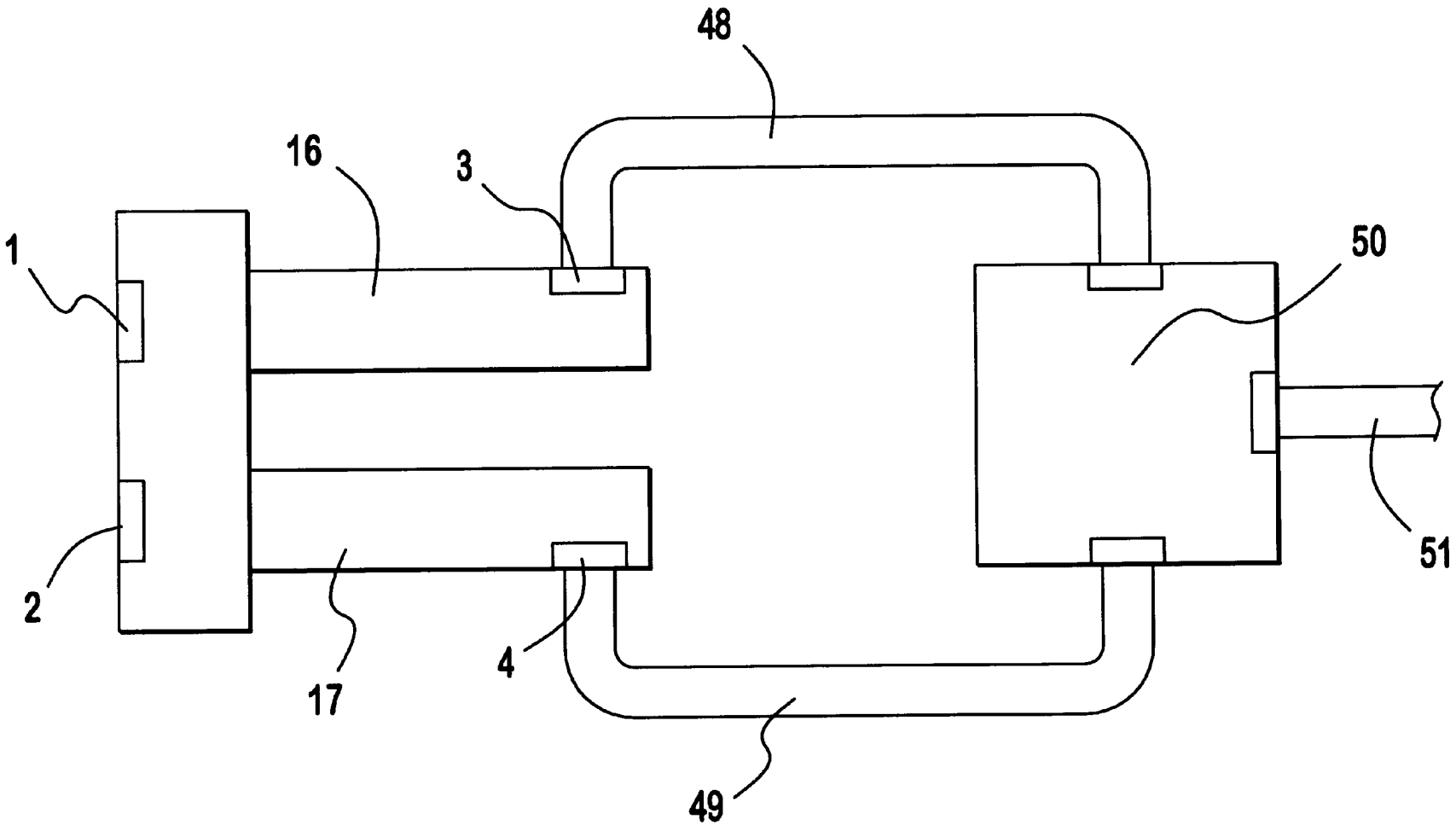
FIG. 10 is a block diagram showing the parallel compressor modules and common outlet cavity.

As the drive shaft 12 is rotated by the driving motor causing the corresponding rotations of the drive gear 9, the driven gears 10, 11, the male rotors 6, 8 and the female rotors 5, 7, air (or any other fluid) in the compressor modules 16, 17 is compressed by the female rotors 5, 7. Upon being compressed by the female rotors 5, 7 the compressed air is forced out of the compressor modules 16, 17 through outlet ports 3, 4. The outlet ports 3, 4 may be connected to a common outlet cavity 50, as shown in FIG. 10 which shows one possible method of combining the compressed fluid produced in each compressor module 16, 17. As shown, outlet ports 3, 4 may be connected to the outlet cavity 50 by means of pipes 48, 49. By connecting the outlet ports 3, 4 via a common outlet cavity, the outlet pressure in each of the compressor modules 16, 17 may be equalized. Moreover, both outlet ports 3 and 4 can be combined, via the outlet cavity 50, to form one common supply header 51 from which the highly compressed fluid can be made available to machinery requiring a constant input of such fluid.

The system provides for the disengagement of either compressor module 16, 17 if failure occurs. For example, if the male rotor 8 or its corresponding female rotor 6 fails or if the two rotors become jammed, the compressor module 16 can be disengaged. To disengage compressor module 16, driven gear 11 is disengaged from drive gear 9. When driven gear 11 is disengaged, drive gear 9 will act solely on driven gear 10 in compressor module 17. As described above, the failed module may be replaced or the compressor can be configured for single module operation by isolating the failed module from the system.

In operation, air flows into the compressor through the two inlet ports 1, 2 into the common inlet cavity 15. Air moves from the inlet cavity 15 through the inlet ports 13, 14 into each compressor module, each of which may be encased within a separate housing. The air is compressed in the modules and then exits each module through a pair of outlet ports 3, 4. As each compressor module has its own outlet, a pressure differential can be achieved between the outlets. In the alternative, each compressor module outlet can lead to a common outlet cavity 50 thereby ensuring that the outlet pressure of each compressor module is the same.

The compressor modules may be liquid-flooded. Accordingly, each module may include a lubricating and cooling fluid ("lubricant/coolant"), preferably oil, being continuously supplied by means of a conduit. The lubricant/coolant is introduced into each compressor module 16, 17 through injection tubes 30, 31. Before being injected into each compressor module 16, 17, the lubricant/coolant travels through dual filter assemblies 32, 33. The lubricant/coolant enters the dual filter assemblies 32, 33 through tubes 34, 35. Each tube 34, 35 also connects to a relief valve manifold 36, 37, respectively, which in turn is connected to a pump 38, 39, respectively. Lubricant/coolant enters the pumps 38, 39 through inlet ports 46, 47. The lubricant/coolant which flows through inlet port 46 flows through a strainer 48 and then into pump 38. Similarly, the lubricant/coolant which flows into inlet port 47 flows through a strainer 49 and then into pump 39.

For safety concerns, each compressor module 16, 17 is provided with a lubricant/coolant pump pressure relief valve 40, 41. The pressure relief valve 40 is connected to relief valve manifold 36. Similarly, pump pressure relief valve 41 is connected to relief valve manifold 37. If the pressure in either pump pressure relief valve 40, 41 rises above a specified level, the valves 40, 41 will open allowing lubricant/coolant to flow into relief valve tubes 42, 43 respectively. Excess lubricant/coolant may be removed from the compressor modules 16, 17 by a drain tube 44, 45.

As shown in FIG. 1, the drain tubes 44, 45 return the lubricant flow from the discharge bearings to the low pressure region of the compressor modules.

After the air (or other fluid) is compressed in each compressor module 16, 17 and exits through outlet ports 3, 4, it may be routed to a moisture separator (not shown) in which entrained lubricant/coolant can be separated from the compressed air. Removing the lubricant/coolant from the compressed air is beneficial for certain machinery which requires a constant supply of compressed air.

Given the disclosure of the present invention, one versed in the art would appreciate that there may be other embodiments and modifications within the scope and spirit of the invention. Such as, for example, providing additional compressor modules acting in parallel while at the same time being driven by one common gearing or by a system of gears all of which are driven by one common drive shaft. Accordingly, all modifications attainable by one versed in the art from the present disclosure within the scope and spirit of the present invention are to be included as further embodiments of the present invention. The scope of the present invention is to be defined as set forth in the following claims.

What is claimed is:

1. A multi-module rotary screw compressor comprising:

a compressor casing having an inlet cavity for receiving a fluid to be compressed;

a plurality of rotary screw compressor modules positioned such that each of said rotary screw compressor modules receives the fluid directly from said inlet cavity, each of said rotary screw compressor modules including a male rotor intermeshed with a female rotor;

a drive shaft operatively connected to the compressor modules;

a drive gear mounted to said drive shaft;

wherein rotation of said drive shaft causes said male rotors to rotate; and wherein rotation of each of said male rotors causes said female rotors to rotate and thereby compress the fluid received from said inlet cavity.

2. The compressor of claim 1, wherein each of said male rotors includes a driven gear which engages said drive gear so that a rotation of said drive shaft and said drive gear causes a corresponding rotation of said driven gears.

3. The compressor of claim 2, wherein the ratio of said drive gear to each of said driven gears is the same.

4. The compressor of claim 1, wherein said casing includes an outlet cavity for each of said rotary screw compressor modules whereby compressed fluid produced in each rotary screw compressor module is supplied to the corresponding outlet cavity.

5. The compressor of claim 1, wherein said casing includes an outlet cavity into which the compressed fluid of each of said rotary screw compressor modules is supplied.

6. The compressor of claim 5, wherein the compressor is configured so that the pressure of the compressed fluid at an outlet of each of said rotary screw compressor modules is substantially the same.

7. The compressor of claim 6, wherein the compressor is configured so that each of said compressor modules contribute substantially equal volumes of compressed fluid to said outlet cavity.

8. The compressor of claim 1, further comprising a conduit for supplying lubricating fluid to the compressor modules.

9. The compressor of claim 1, wherein each compressor module is a liquid-flooded rotary screw compressor.

10. The compressor of claim 1, wherein said compressor is configured so that each of said compressor modules produces compressed fluid at substantially the same discharge pressure.

11. The compressor of claim 1, wherein the plurality of compressor modules are mounted so that in a first compressor module the male rotor is positioned above the female rotor and in a second compressor module the male rotor is positioned below the female rotor.

12. The compressor of claim 1, further comprising bearings positioned to establish a clearance between each of the rotors and the casing.

13. A multi-module rotary screw compressor comprising:

a compressor casing having an inlet cavity for receiving a fluid to be compressed;

a plurality of rotary screw compressor modules positioned to receive the fluid directly from said inlet cavity, each of said rotary screw compressor modules including a male rotor intermeshed with a female rotor;

a drive shaft operatively connected to the compressor modules;

a drive gear mounted to said drive shaft;

wherein rotation of said drive shaft causes said male rotors to rotate;

wherein rotation of each of said male rotors causes said female rotors to rotate and thereby compress the fluid received from said inlet cavity, and wherein the compressor includes a pair of compressor modules positioned on opposite sides of the drive shaft offset by an angle selected to provide sufficient loading on the drive shaft bearings while minimizing the size of the casing the diameter of drive gear.

14. The compressor of claim 13, wherein the offset angle is approximately 30 degrees.

15. A multi-module rotary screw compressor comprising:

a compressor casing having an inlet cavity for receiving a fluid to be compressed;

a plurality of rotary screw compressor modules positioned to receive the fluid directly from said inlet cavity, each of said rotary screw compressor modules including a male rotor intermeshed with a female rotor;

a drive shaft operatively connected to the compressor modules;

a drive gear mounted to said drive shaft;

wherein rotation of said drive shaft causes said male rotors to rotate;

wherein rotation of each of said male rotors causes said female rotors to rotate and thereby compress the fluid received from said inlet cavity; and wherein each of said male rotors includes a driven gear which engages said drive gear so that a rotation of said drive shaft and said drive gear causes a corresponding rotation of said driven gears and each of said driven gears is configured to be disengaged from said drive gear so that said compressor modules may operate independently.

16. A method of producing compressed air in a compressor casing comprising the steps of:

rotating a drive shaft;

rotating a first male rotor in a first rotary screw compressor module, wherein the first rotary screw compressor module is operatively connected to the drive shaft;

rotating a first female rotor in the first rotary screw compressor module;

rotating a second male rotor in a second rotary screw compressor module, wherein the second rotary screw compressor module is operatively connected to the drive shaft;

rotating a second female rotor in the second rotary screw compressor module;

providing air to each compressor through a common inlet cavity so that each compressor module discharges compressed air, and further comprising the steps of;

disconnecting the first compressor module from the drive shaft; and rotating the second compressor module independently from the first compressor module to discharge compressed air out of the second compressor module.

17. The method of claim 16, further comprising the step of:

providing lubricating fluid to each compressor module.

* * * * *